US009136067B2

(12) United States Patent
Bausch et al.

(10) Patent No.: US 9,136,067 B2
(45) Date of Patent: Sep. 15, 2015

(54) ROTATIVE DOUBLE CONTACT

(75) Inventors: Christoph Bausch, Bonn (DE); Franz Boeder, Adenau (DE); Uwe Linzenich, Simmerath (DE); Bogdan Zabrocki, Neunkirchen-Seelscheid (DE)

(73) Assignee: EATON INDUSTRIES GMBH, Bonn (DE)

( * ) Notice: Subject to any disclaimer, the term of this patent is extended or adjusted under 35 U.S.C. 154(b) by 129 days.

(21) Appl. No.: 13/509,627

(22) PCT Filed: Nov. 11, 2010

(86) PCT No.: PCT/EP2010/067328

§ 371 (c)(1),
(2), (4) Date: May 14, 2012

(87) PCT Pub. No.: WO2011/058120

PCT Pub. Date: May 19, 2011

(65) Prior Publication Data

US 2013/0048484 A1 Feb. 28, 2013

(30) Foreign Application Priority Data

Nov. 12, 2009 (DE) ..... 10 2009 052 965

(51) Int. Cl.
*H01H 1/22* (2006.01)
*H01H 1/20* (2006.01)
(Continued)

(52) U.S. Cl.
CPC ..... *H01H 1/205* (2013.01); *H01H 73/045* (2013.01); *H01H 77/104* (2013.01)

(58) Field of Classification Search
CPC ... H01H 1/2058; H01H 1/205; H01H 1/2041; H01H 1/2025; H01H 73/045
USPC ..... 200/244, 501, 271, 272
See application file for complete search history.

(56) References Cited

U.S. PATENT DOCUMENTS 4,910,485 A 3/1990 Bolongeat-Mobleu et al.
5,093,544 A * 3/1992 Lesslie et al. ..... 200/244
(Continued)

FOREIGN PATENT DOCUMENTS

DE 19933614 C1 11/2000
DE 19933919 A1 1/2001
(Continued)

OTHER PUBLICATIONS

European Patent Office, International Search Report in International Patent Application No. PCT/EP2010/067328 (Feb. 10, 2011).

*Primary Examiner* — Felix O Figueroa
(74) *Attorney, Agent, or Firm* — Leydig, Voit & Mayer, Ltd.

(57) ABSTRACT

A contact system for a pole of a low-voltage switchgear includes a rotary contact mounted movably in a rotor housing. The rotary contact includes at least a first rotary contact body having a first and second lever arm. Each of the lever arms include a lever arm end having a contact piece. A first and second fixed contact each cooperate with a respective one of the contact pieces. A first spring acts on the first lever arm and a second spring acts on the second lever arm. Each of the springs have a first support at a first end, a spring body and a second support at a second end. The first supports directly engage the first rotary body and the second supports are disposed at the rotary housing. Each of the spring bodies are disposed on a same side of the first rotary contact body.

12 Claims, 4 Drawing Sheets

(51) Int. Cl.
*H01H 73/04* (2006.01)
*H01H 77/10* (2006.01)

(56) References Cited

U.S. PATENT DOCUMENTS

| | | | | |
|---|---|---|---|---|
| 5,146,194 | A * | 9/1992 | Altenhof et al. | 200/244 |
| 5,566,818 | A * | 10/1996 | Kuboyama et al. | 200/271 |
| 6,403,901 | B1 | 6/2002 | Boeder et al. | |
| 7,005,594 | B2 * | 2/2006 | Kim | 200/244 |
| 7,777,601 | B2 * | 8/2010 | Kakisako et al. | 200/272 |
| 2006/0077022 | A1 | 4/2006 | Kim | |
| 2009/0065341 | A1 | 3/2009 | Shmukler et al. | |
| 2011/0147373 | A1 | 6/2011 | Zernickel et al. | |

FOREIGN PATENT DOCUMENTS

| | | | |
|---|---|---|---|
| DE | 10150550 | C1 | 12/2002 |
| DE | 102008007363 | A1 | 8/2009 |
| DE | 102008038967 | A1 | 3/2010 |
| DE | 102008049442 | A1 | 4/2010 |
| EP | 0314540 | A1 | 5/1989 |
| WO | WO 0241346 | A1 | 5/2002 |
| WO | 102008049602 | A1 | 4/2010 |

* cited by examiner

ROTATIVE DOUBLE CONTACT

CROSS-REFERENCE TO PRIOR APPLICATIONS

This application is a U.S. National Phase application under 35 U.S.C. §371 of International Application No. PCT/EP2010/067328, filed on Nov. 11, 2010, and claims benefit to German Patent Application No. DE 10 2009 052 965.9, filed on Nov. 12, 2009. The International Application was published in German on May 19, 2011 as WO 2011/058120 under PCT Article 21(2).

FIELD

The invention relates to a contact system for in each case one pole of a low-voltage switchgear, comprising a rotary contact mounted rotatably in a rotor housing against a spring force. The rotary contact consists of at least one rotary contact body, on the opposing lever arms of which contact pieces are arranged. The contact system additionally comprises two fixed contacts each cooperating with the contact piece of a lever arm end.

BACKGROUND

EP 0 314 540 B1 discloses in FIG. 4 a switchgear for a low-voltage circuit breaker having a switching shaft extending through a plurality of poles, each pole having a double contact mounted on the switching shaft. Owing to the rotative double contact, two series-connected arcs are enabled on opening of the switchgear. The series connection of the arcs effects higher current limiting. The known double contact has two parallel contact fingers in order to permit a higher current-carrying capacity of the double contact. The power loss and the associated heating of the contact fingers are reduced and the lift-off limit is raised. The contact fingers arranged in parallel are connected to the switching shaft by way of one tension spring per contact point. The tension spring arranged above and below the contact finger generates a contact force moment when the contacts are closed and always acts upon the two parallel contact fingers simultaneously by way of a coupling element. The installation space of the contact system is very large owing to the tension springs extending above and below.

DE 199 33 614 C1 discloses a contact system having a two-armed contact arm. On both sides of the contact arm there extend per end of the contact arm in each case two contact force springs. Owing to this arrangement, the installation space of the contact system is likewise very large. In order to construct a parallel arrangement of two or more contact arms for the purpose of a higher current-carrying capacity, the contact systems must be arranged next to one another, which increases the required installation space. The fixed contacts corresponding to the contact arms must also have a certain width in order to contact two or more parallel contact arms. Alternatively, a plurality of fixed contacts arranged in parallel must be used.

A further contact system is known, in which only one contact arm is formed (DE 102008007363 A1). The contact arm is acted upon by at least one contact force spring, but a mechanical coupling element is interposed between the contact force spring and the contact arm. The use of the coupling element serves to make the application of force symmetrical, but the construction of the contact system is made wider as a result.

SUMMARY

In an embodiment, the present invention provides a contact system for a pole of a low-voltage switchgear including a rotary contact mounted movably in a rotor housing. The rotary contact includes at least a first rotary contact body having a first and a second lever arm. Each of the lever arms include a lever arm end having a contact piece. The lever arm ends are opposed to one another. A first and a second fixed contact each cooperate with a respective one of the contact pieces of the first and the second lever arms. A first spring acts on the first lever arm and a second spring acts on the second lever arm. Each of the springs has a spring body and is supported at a first respective end by direct engagement with the first rotary body and is supported at a second respective end on the rotary housing. Each of the spring bodies is disposed on a same side of the first rotary contact body.

BRIEF DESCRIPTION OF THE DRAWINGS

The present invention will be described in even greater detail below based on the exemplary figures. The invention is not limited to the exemplary embodiments. Features described and/or depicted can be used individually or combined in different embodiments. Other features and advantages of various embodiments of the present invention will become apparent by reading the following detailed description with reference to the attached drawings which illustrate the following.

DETAILED DESCRIPTION

Figure 1:
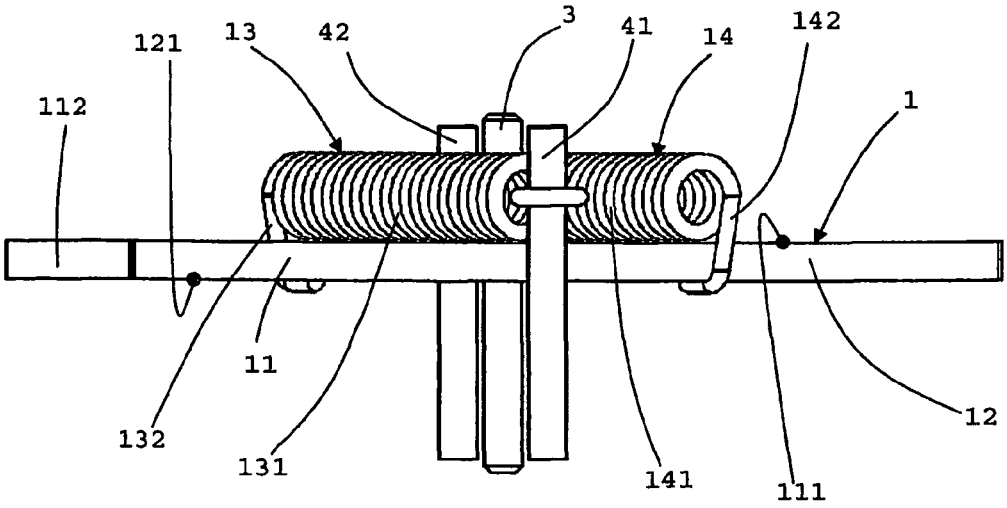
FIG. 1 shows a top view of an embodiment of a rotary contact having one rotary contact body with two lever arm ends.

In an embodiment, the invention provides a modular rotary contact system for switchgears which has a particularly narrow construction and is suitable for a narrow construction of a double contact system.

The invention, in an embodiment, provides a contact system for in each case one pole—that is to say one phase of the current—of a low-voltage switchgear, comprising a rotary contact mounted rotatably in a rotor housing against a spring force. The rotary contact consists of at least one rotary contact body, at the opposing lever arm ends of which contact pieces (moving contact pieces) are arranged. The contact system additionally comprises two fixed contacts each cooperating with the contact piece of a lever arm end. Each lever arm is acted upon by a spring, which is supported at one end on the rotary contact body and at the other end on the rotor housing. The spring bodies of the two springs are arranged on the same flat side, or side face, of the rotary contact body. By using only two springs per rotary contact body, the dimensions of the contact system are reduced.

The arrangement according to an embodiment of the invention has the particular feature that contact force springs are arranged on only one of the side faces of the rotary contact body and engage directly with the rotary contact body, that is to say without a mechanical coupling element (or transmission member) between the contact force spring and the rotary contact body. This arrangement has the crucial advantage that the width of the rotary contact body and the contact force spring (next to one another) is determined only by the thickness of the rotary contact body plus the diameter of the spring body. Contact force springs arranged on both sides of the rotary contact body give a broader construction. The non-symmetrical (one-sided) application of force by the contact force springs is not a disadvantage, as is shown by the applicant's own investigations, because the applied forces of the two springs balance one another out. There is no tilting of the rotary contact body, which is also attributable in part to the fact that the contact force springs sit close on the rotary contact body.

The preferred embodiment has for the rotary contact two rotary contact bodies which are arranged next to one another parallel to their long sides. They together form a parallel arrangement of the contacts.

Advantageously, the springs are located on the long sides of the rotary contact bodies that face away from one another. There are no springs between the two rotary contact bodies. It has further been found to be advantageous for each fixed contact to be associated with two contact pieces at the two lever arm ends of the rotary contact bodies. A particularly compact construction of the contact system can thus be achieved because the fixed contacts, owing to the fact that the contact elements of each lever arm end are located close to one another, can be of narrow form. As a result, it is also not necessary to use a plurality of parallel fixed contacts per lever arm end.

By using two parallel rotary contact bodies, the lift-off limit of the contacts is improved and the power loss is reduced. It is important that the application of the spring force for each rotary contact body takes place independently of the other.

In this preferred embodiment, the compressive forces in the contact pairings oscillate independently of one another. The contact force torque in each contact remains optimal with different degrees of loss of contact piece material and, associated therewith, with a change of the spring force lever arms.

Advantageously, the rotary contact body or bodies is/are mounted for rotation about a shaft.

It has further been found to be advantageous for the spring hooks of the springs to grip the rotary contact body. Alternatively, the rotary contact bodies have in each lever arm a fastening bore through which the spring hooks of the springs engage. A further alternative for fastening the springs to the rotary contact body are holding elements, such as pegs, rivets, pins or screws, which protrude laterally from the long side. The protruding holding element can further be formed in one piece from the rotary contact body.

The second support of the springs at the other end on the rotor housing can consist of a holding pin.

The mentioned features of the embodiments of the invention can be claimed individually or together.

Figure 2:
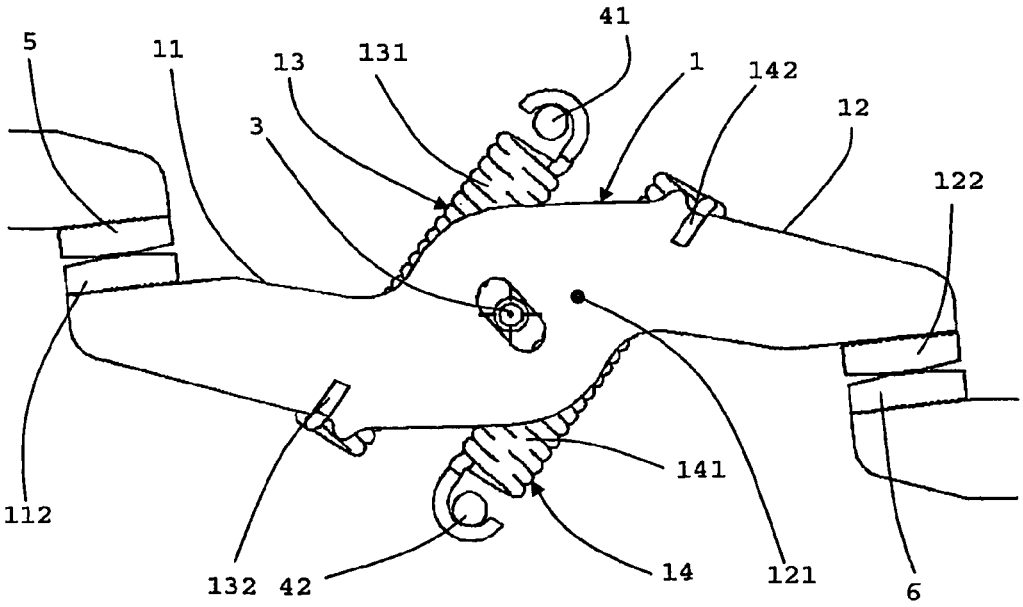
FIG. 2 shows a side view of the rotary contact of FIG. 1.

FIGS. 1 and 2 disclose an embodiment of a rotary contact having a single rotary contact body 1. The rotary contact body 1 is formed of a highly conductive flat material having side faces (111, 121) perpendicular to the axis of rotation (shaft 3) of the rotary contact body and narrow sides in the form of faces perpendicular to the side faces.

The rotary contact body has two lever arms 11, 12 which each have a contact piece (moving contact) 112, 122 at their end. In a centrally arranged region, the rotary contact body 1 has an opening with which the rotary contact body 1 is rotatably mounted on a shaft 3. The rotary contact body 1 can, however, also be mounted movably, in a floating manner, without a shaft 3.

The contact pieces 112, 122 are arranged at opposing lever arm ends 11, 12. Opposite each contact piece 112, 122 is an associated fixed contact 5, 6. In FIG. 2 (also in FIG. 6), the rotary contact is closed; the contact pieces 112, 122 (212, 222) are resting on the fixed contacts 5, 6. Rotation of the rotary contact body 1 counter-clockwise causes the rotary contact to be opened. A spring 13, 14 is attached to each lever arm 11, 12. The springs 13, 14 each consist of a spring body 131, 141 to one end of which there is attached a spring hook 132, 142 for fastening to the rotary contact body 1. In the embodiments shown in the figures, only tension springs in the form of helical springs 13, 14 are disclosed. It is, however, also conceivable to use different types of spring, such as, for example, compression springs. In that case, the springs must be connected to the rotary contact bodies 1, 2 in a correspondingly different way.

Each spring 13, 14 is additionally supported on the rotor housing 4 by way of a holding pin 41, 42, so that the contact pieces 112, 122 of the lever arms 11, 12 are pressed onto the fixed contacts 5, 6. In the embodiment of FIGS. 1 to 6 and 7*a*, the springs 13, 14 are fastened to the lever arms 11, 12 by way of a stirrup-shaped spring hook 132, 142, which adjoins the spring body 131, 141 directly and grips the narrow edge of the lever arms 11, 12 of the rotary contact body 1. Other means of fastening the springs 13, 14 to the lever arms 11, 12 are also conceivable. For example, the springs 13, 14 can engage around pegs 114 attached to the narrow side of the lever arms 11, 12 (see FIG. 7*b*) or can embrace corresponding pegs, rivets, pins, bent portions or screws attached to the long side 111, 121 of the lever arms 11, 12 (see FIGS. 7*c, d* and *e*). It is also possible for a fastening bore 113 in the lever arm 11, 12 to receive and thus hold the spring hook 132, 142 of the spring 13, 14. Similar fastening possibilities for the springs 13, 14 are also conceivable on the rotor housing 4.

The spring bodies 131, 141 are located on one of the long sides 111 of the rotary contact body 1. The long sides 111, 121 lie perpendicular to the axis of rotation and denote the sides of the rotary contact body 1 having the greatest surface area. The narrow sides of the rotary contact body 1, on the other hand, have only a very small surface area.

If the forces of the two springs 13, 14 are balanced, the rotary contact body 1 cannot tilt over its narrow side because the springs 13, 14 each exert an opposite force on the rotary contact body 1.

Figure 3:
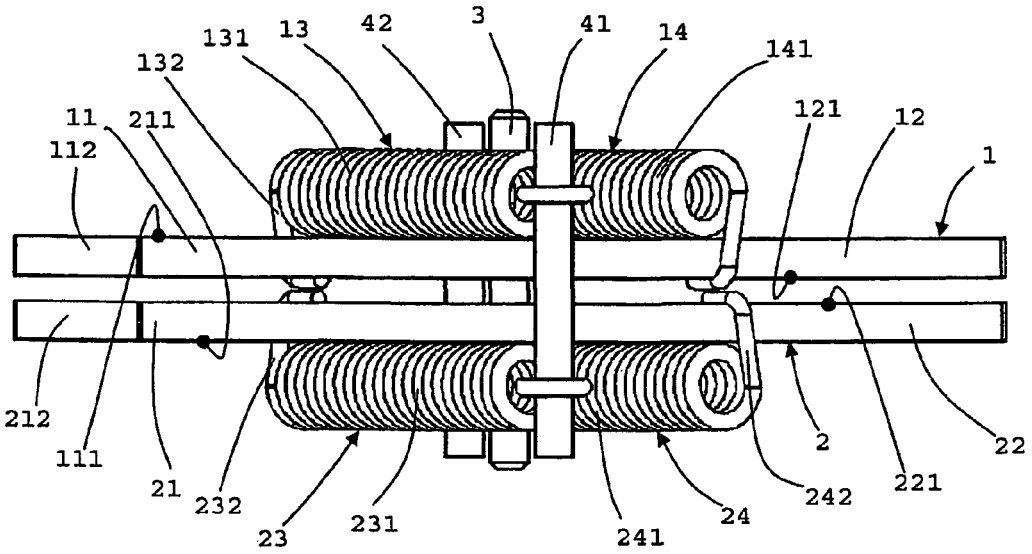
FIG. 3 shows a top view of an embodiment of a further rotary contact according to an embodiment of the invention having two rotary contact bodies without a rotor housing.
Figure 4:
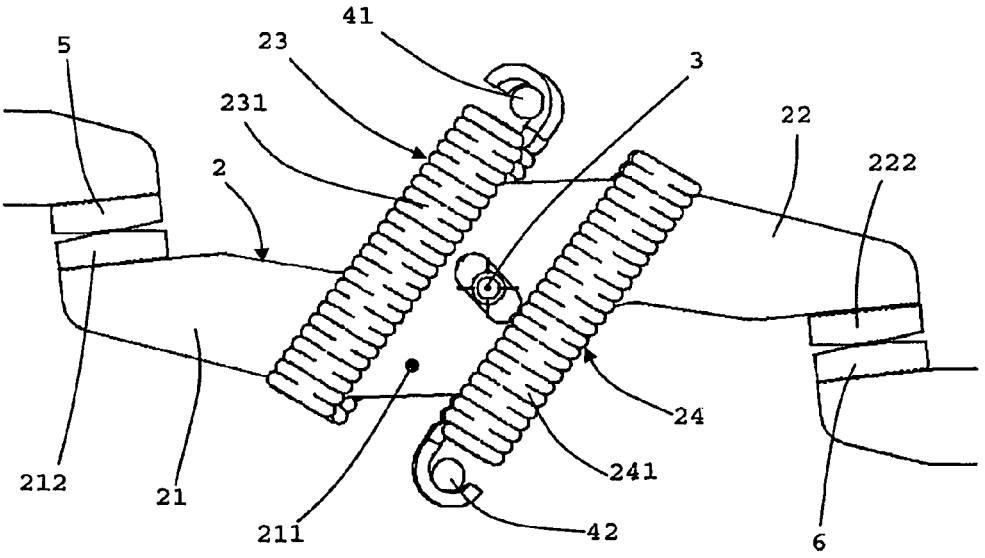
FIG. 4 shows a side view of the rotary contact of FIG. 3.

FIGS. 3 and 4 show a preferred embodiment of the invention, wherein the same reference numerals as in FIG. 1 and FIG. 2 are used correspondingly. This rotary contact consists of two rotary contact bodies 1, 2, the second rotary contact body 2 lying (concealed) behind the drawing plane in FIG. 4.

The long sides 111, 211 of the rotary contact bodies 1, 2 provided with the springs 13, 14, 23, 24 are remote from one another. This arrangement allows the rotary contact bodies 1, 2 to be disposed very close together in parallel, which has the result that the fixed contacts 5, 6 associated with the contact pieces 112, 212 and 122, 222 located next to one another can be very narrow. Each rotary contact body 1, 2 is acted upon by a contact force by way of two springs 13, 14, 23, 24. In this case, the contact forces of the rotary contact bodies 1, 2 are independent of one another.

Figure 5:
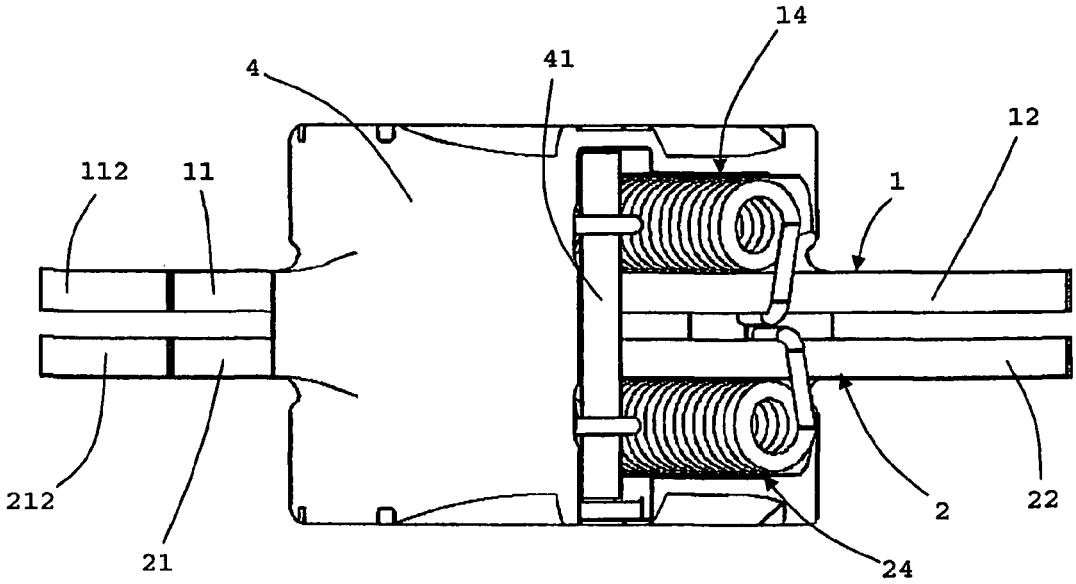
FIG. 5 shows a top view of an embodiment of a rotary contact according to an embodiment of the invention having two rotary contact bodies with a rotor housing.
Figure 6:
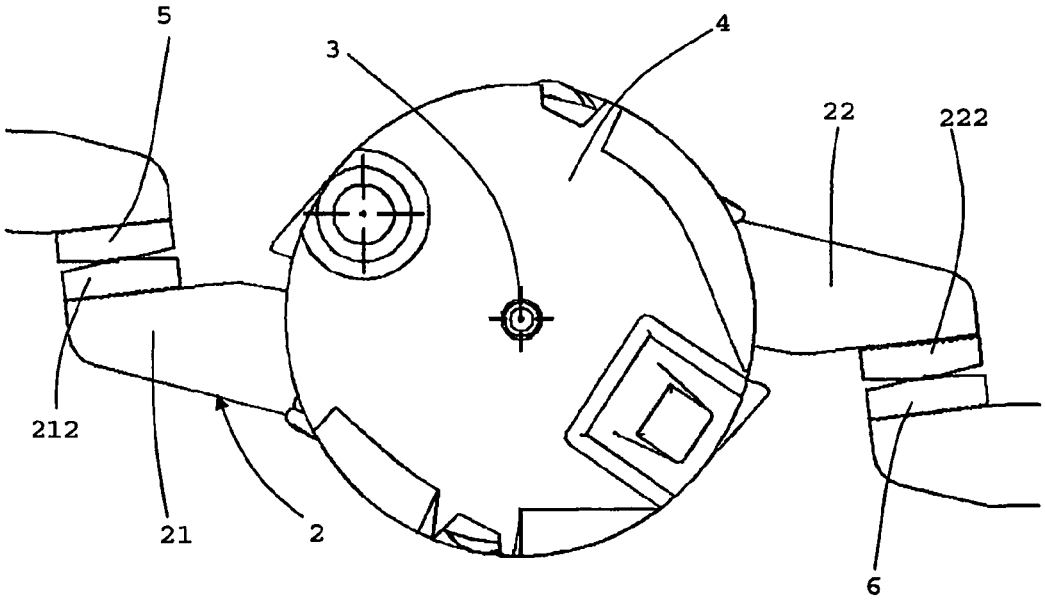
FIG. 6 shows a side view of the rotary contact of FIG. 5.
Figure 7A:
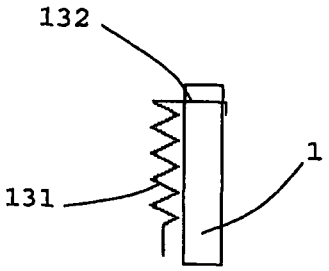
FIG. 7 shows schematic diagrams of five different means (a-e) according to an embodiment of the invention for attaching the springs to the rotary contact body.
Figure 7B:
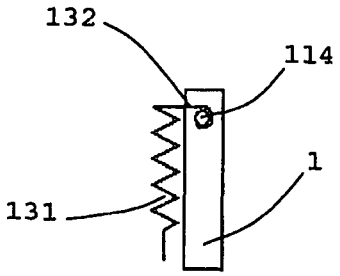
Figure 7C:
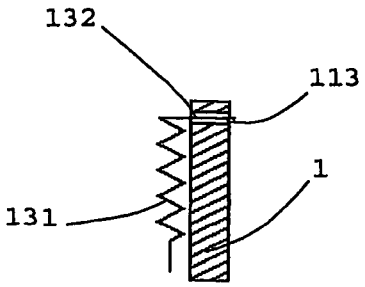
Figure 7D:
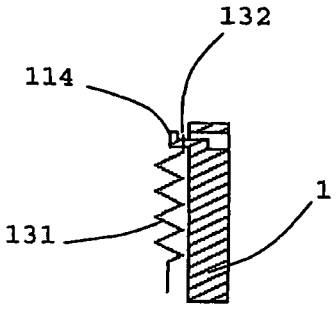
Figure 7E:
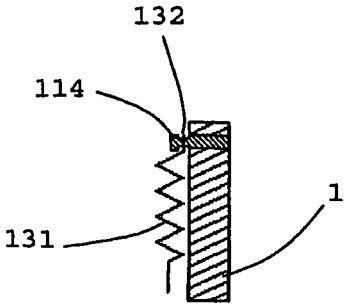

FIGS. 5 and 6 show the embodiment of FIGS. 3 and 4 with an additional rotor housing 4. The rotor housing 4 is made of insulating material and encloses the middles of the two rotary contact bodies 1, 2 as well as the springs 13, 14, 23, 24. The rotor housing 4 is stationary with respect to the rotatably-mounted rotary contact bodies 1, 2 and additionally forms stops for the rotary contact bodies 1, 2.

FIG. 7 gives schematic diagrams (7*a*-7*e*) of five different means 132 according to an embodiment of the invention for attaching the spring to the rotary contact body. In FIG. 7*a*, the attachment means in the form of a hook 132 of a spring is placed over the narrow side. In FIG. 7*b*, the attachment means is shown in the form of a pin 132 protruding from the narrow side. In FIG. 7*c*, the attachment means 132 is a bore 113. In FIG. 7*d*, the attachment means consists of a protruding holding element 114, and in FIG. 7*e* a protruding peg set into the rotary contact body is used.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS rotary contact body
11, 12 lever arm
111, 121 side face
112, 122 contact piece
113 fastening bore
114 holding element (peg)
13, 14 spring
131, 141 spring body
132, 142 spring hook
2 rotary contact body
21, 22 lever arm
221 side faces
222 contact piece
23, 24 spring
231, 241 spring body
232, 242 spring hook
3 Shaft
4 rotor housing
41, 42 holding pin
5, 6 fixed contact

The invention claimed is:

1. A contact system for a pole of a low-voltage switchgear, comprising:

a rotary contact mounted movably in a rotor housing, the rotary contact including at least a first rotary contact body having a first and a second lever arm, each of the lever arms including a lever arm end having a contact piece, the lever arm ends being opposed to one another;

a first and a second fixed contact each cooperating with a respective one of the contact pieces of the first and the second lever arms; and a first spring acting on the first lever arm and a second spring acting on the second lever arm, each of the springs having a spring body and being supported at a first respective end by direct engagement with the first rotary contact body and being supported at a second respective end on the rotor housing, each of the spring bodies being disposed on a same first side of the first rotary contact body and a second side of the first rotary contact body opposite the first side being free of spring bodies, wherein the second side of the first rotary contact body is not fixedly connected with another rotary contact body that has a lever arm which is acted upon by another spring.

2. The contact system according to claim 1, wherein the first rotary contact body is rotatably mounted about a shaft.

3. The contact system according to claim 1, further comprising a second rotary contact body disposed parallel and adjacent to the first rotary contact body.

4. The contact system according to claim 3, wherein the first and the second rotary contact bodies each include respective ones of the spring bodies on respective same sides and are disposed adjacent to each other with the same side of the first contact body and the same side of the second contact body facing away from one another.

5. The contact system according to claim 3, wherein the first and the second fixed contacts cooperate with each of the first and the second contact bodies.

6. The contact system according to claim 1, wherein each of the first and the second spring include a spring hook at the first end configured to grip the first rotary contact body.

7. The contact system according to claim 1, wherein each of the first and the second spring include a spring hook at the first end and the first rotary contact body includes a fastening bore configured to receivably engage one of the spring hooks.

8. The contact system according to claim 1, wherein the first rotary contact body includes a holding element protruding laterally from the same side of the first rotary at which the spring bodies are disposed.

9. The contact system according to claim 8, wherein the holding element is at least one of a peg, a rivet, a pin, and a screw.

10. The contact system according to claim 8, wherein the holding element and the first rotary contact body are in an integral, one-piece construction.

11. The contact system according to claim 1, wherein the springs are supported at the second respective ends on the rotor housing by a holding pin.

12. The contact system according to claim 1, wherein the springs are helical springs.

* * * * *